US006266866B1

(12) United States Patent
Ramirez et al.

(10) Patent No.: US 6,266,866 B1
(45) Date of Patent: Jul. 31, 2001

(54) FROG INSERT AND ASSEMBLY AND METHOD FOR MAKING FROG ASSEMBLY

(75) Inventors: Jacqueline Ramirez, Abbotsford; Al Forshaw, Surrey, both of (CA); Gary Click, Birmingham, AL (US)

(73) Assignee: VAE Nortak North America Inc., Cheyenne, WY (US)

( * ) Notice: Subject to any disclaimer, the term of this patent is extended or adjusted under 35 U.S.C. 154(b) by 0 days.

(21) Appl. No.: 09/357,729

(22) Filed: Jul. 21, 1999

(51) Int. Cl.[7] ..... B23P 17/00

(52) U.S. Cl. ..... 29/527.6; 246/454; 246/460; 246/468

(58) Field of Search ..... 246/454, 460, 246/461, 468, 469, 472, 458, 464; 29/527.6, 894.1

(56) References Cited

U.S. PATENT DOCUMENTS

| | | | | |
|---|---|---|---|---|
| 258,259 | * | 5/1882 | Staples | 246/454 |
| 555,772 | * | 3/1896 | Howe et al. | 246/468 |
| 746,022 | * | 12/1903 | Chapman | 246/468 |
| 1,032,577 | * | 7/1912 | Alden | 246/468 |
| 3,480,072 | * | 11/1969 | Heim et al. | 246/468 |
| 3,697,747 | * | 10/1972 | Edeling et al. | 246/468 |
| 3,755,670 | * | 8/1973 | Damy | 246/468 |
| 4,824,055 | * | 4/1989 | Tuningley et al. | 246/458 |
| 5,133,522 | * | 7/1992 | Testart | 246/468 |
| 5,496,004 | * | 3/1996 | Kuhn | 246/470 |
| 5,653,408 | * | 8/1997 | Kuhn et al. | 246/470 |
| 5,877,468 | * | 3/1999 | Morlock | 219/54 |

FOREIGN PATENT DOCUMENTS

| | | | | |
|---|---|---|---|---|
| FR 555424 | * | 3/1957 | (BE) | 246/454 |
| 1157444 | * | 11/1983 | (CA) | 246/454 |
| CA 1252723 | * | 12/1960 | (FR) | 246/454 |
| 94/19542 | * | 2/1994 | (WO) | E01B/7/12 |

* cited by examiner

*Primary Examiner*—S. Thomas Hughes
*Assistant Examiner*—Essama Omgba
(74) *Attorney, Agent, or Firm*—Galgano & Burke

(57) ABSTRACT

An improved cast insert for a railway frog has two extensions extending in substantially the same direction away from the body portion of the casting and the end of each of the extensions has a cross sectional profile corresponding to the profile of the head and web of a rail but including only one side of what would normally be the base of a rail. A frog assembly is made by providing such an insert, machining each of two rails to also remove one side of the base near the end of the rail and attaching the machined end of each of the two rails to the end of one of said extensions such that the sides of the rails from which the base has been machined away face one another.

12 Claims, 18 Drawing Sheets

FROG INSERT AND ASSEMBLY AND METHOD FOR MAKING FROG ASSEMBLY

TECHNICAL FIELD OF THE INVENTION

This invention relates to railroad frogs. In particular, this invention relates to a casting for a railroad frog and to a method for connecting a frog casting to heel and toe rails in a frog assembly.

BACKGROUND

A "frog" is a component of track work used to allow one rail line to intersect and cross another rail line. A frog is typically supplied as an assembly of a casting which includes the point of frog, and heel and toe rails which are attached to the casting. The frog is inserted between intersecting rail lines by attaching the heel and toe rails of the frog assembly to the running rails of the intersecting rail lines.

It is a known feature of frogs that they are subjected to very high stresses, including notably stresses on the casting resulting from the impact of the wheels. This tends to wear and ultimately damage the castings. Accordingly it is desirable to use materials in the casting which are capable of withstanding the stresses involved. Manganese steel alloy is an example of a material widely used for this purpose because of its high degree of hardness and its ability to resist wear and impact damage. However the cost of manganese is high resulting in a relatively high cost of manufacturing frogs using manganese steel castings. In addition, while the use of manganese extends the life of the casting, it is still subject to impact damage and eventual wear.

We turn to consider various types of frogs and the steps that have been taken to try to minimize impact damage, maintenance requirements and costs of the frogs.

A common type of frog is known as the Rail Bound Manganese ("RBM") frog. The RBM is characterized by a casting of manganese steel alloy, heel and wing rails attached to the casting, spacer blocks and other components. The components of the frog are mechanically attached to one another and to base elements by means of a number of rail bolts and other fastening elements.

The heel end of an RBM casting is joined to heel rails by a mechanical connection. The connection is achieved by sandwiching the heel extension of the casting between the webs of a pair of heel rails, and by inserting a bolt transversely through the heel extension and the webs of the heel rails. This mechanical connection sometimes results in only a small gap between the heel end of the casting and the heel rails, but a small gap is sufficient to cause non-negligible impact damage when the wheels of the train pass over the gap. Even where an attempt is made to ensure a tight mechanical connection so as to minimize the gap, the weight of the train nonetheless causes relative vertical movement between the heel extension and the heel rails thereby creating a ridge against which the wheels of the train impact.

Flash butt welding is not a practical option for eliminating the gap or the relative movement of the components. Flash butt welding would induce arcing between the casting and the pair of heel rails. In any event, flash butt welding would be very difficult because of the geometry of the connection between the heel extension and the heel rails in an RBM type of frog. As a result of the mechanical connection between the heel extension and the heel rails in an RBM frog, damage occurs to the casting and the casting has a relatively short life span requiring replacement of the frogs. RBM frogs also include a number of rail bolts along the length of the frogs, and such rail bolts tend to break with wear. As a result, RBM frogs also require periodic maintenance for the replacement of broken bolts.

In an attempt to avoid the impact damage resulting from the mechanical connection between the casting and the heel rails, a frog known as the welded heel manganese ("WHM") frog was developed. In the WHM, the mechanical joint which would normally be found between the heel end of the casting and the heel rails is eliminated and replaced with a flash butt weld. This is made possible by creating a specially formed heel rail assembly which includes a flat end suitable to be flash butt welded to the casting.

The specially formed heel rail assembly of a WHM frog is created by machining one side of two heel rails so that they each present a flat vertical side extending a short distance along the rails. The two resulting flat surfaces are brought together and welded into a solid assembly. The merged ends of the heel rails are then machined flat. Because the heel rail assembly now presents a flat end, it can be flash butt welded to the end of the casting. This avoids the need for a long heel extension on the casting and allows the casting to be terminated much closer to the point of frog. As a result, a WHM insert can be cast shorter than an RBM insert, thereby using less manganese and reducing costs, in addition to eliminating a mechanical joint between the heel rails and the casting.

The welding of the end sections of the heel rails in the construction of a WHM heel rail assembly is typically done by means of sub-arc welding (the elements to be welded are submerged in sand). However, it appears that sub-arc welding may introduce defects into the heel rail assembly thereby subjecting the assembly to failure in the field. The WHM also suffers from the disadvantage of still requiring mechanical connection to the wing rails, base and other components associated with the frog, thereby requiring on-going maintenance.

An alternative to the RBM and WHM frogs for smaller angles of frogs is the Jointless Boltless Manganese ("JBM") frog. The overall JBM frog assembly is designed to occupy precisely the same footprint as an RBM assembly having the same angle of frog. However, the JBM insert is larger than the RBM insert and the wing rails and other components which would normally be found in the RBM or the WHM are integrally formed with the casting. The JBM insert is also longer than a WHM insert and encompasses what would be a substantial portion of the heel rail assembly of a WHM frog.

In a JBM frog, flash butt welding is used to connect the heel rails and toe rails to the casting. The JBM frog includes substantially no mechanical joints and no bolts other than those associated with spacer blocks used between the two heel rails and the two toe rails. As a result, the JBM frog requires very little maintenance. However, manganese is an expensive alloy and the JBM uses a relatively greater quantity of manganese than the RBM or the WHM. In addition, there are practical limits on the size of casting which may be cast by most foundries.

A shorter length of casting suggests that the rails will be closer together at the point at which they attach to the frog. It is generally thought not to be possible to effectively attach the rails to the inserts unless there is a distance of at least several inches between the centers of the heads of the rails. Attempts to attach rails closer together are defeated by abutment of the base of the rails against one another thereby limiting the extent to which they can be brought closely parallel. In addition, in the case of welding, the slag and other upset material produced can not effectively be removed from the weld area due to the inability to introduce the pneumatic chisel or other device in the area between the webs of the adjacent rails.

It is therefore an object of this invention to allow rails to be welded to the insert in closer proximity than has heretofore been possible in the prior art.

It is also an objective of the present invention to provide a frog which minimizes the number of mechanical joints.

It a further objective of the invention to allow the casting to be welded to the heel and toe rails rather than being mechanically connected as in the case of the RBM style of frogs.

It is another objective of the invention to eliminate the problems associated with sub-arc welding of the heel rail assembly in the WHM style of frogs.

It is also an objective of the present invention to have a casting which is shorter and which increases the range of angles of frog which can be achieved as compared to the JBM style of frog.

SUMMARY OF THE INVENTION

In one of its aspects, the invention comprises an improved cast insert for a railway frog having two extensions extending in substantially the same direction away from the body portion. The end of each of the extensions has a cross sectional profile corresponding to the profile of the head and web of a rail but including only one side of what would normally be the base of a rail.

In another aspect the invention comprises a railroad frog assembly comprising a cast insert as described above and an end of one rail attached to each of the extensions. The end of each of the attached rails has a profile matching the profile of the extension to which the rail is attached.

In another aspect, the invention comprises a method of manufacturing a frog assembly comprising the steps of providing a cast insert as described above, machining each of two rails so as to remove one side of the base of each rail near the end of the rail, and attaching the machined end of each of the two rails to the end of one of said extensions such that the sides of the rails from which the base has been machined away face one another.

In another aspect, the method according to the invention includes the step of removing slag and upset material resulting from the weld by means of a tool introduced through a gap created by the missing inside base portions of the extensions and rails.

The foregoing summary is not exhaustive of these and other aspects of the invention. Such aspects may be more fully appreciated by reference to the description of the preferred embodiment of the invention, and by reference to the claims.

BRIEF DESCRIPTION OF THE DRAWINGS

The invention may be more fully appreciated by reference to the following description of the preferred embodiment and by reference to the drawings thereof in which.

DETAILED DESCRIPTION OF THE BEST MODE AND PREFERRED EMBODIMENTS OF THE INVENTION

Figure 1:
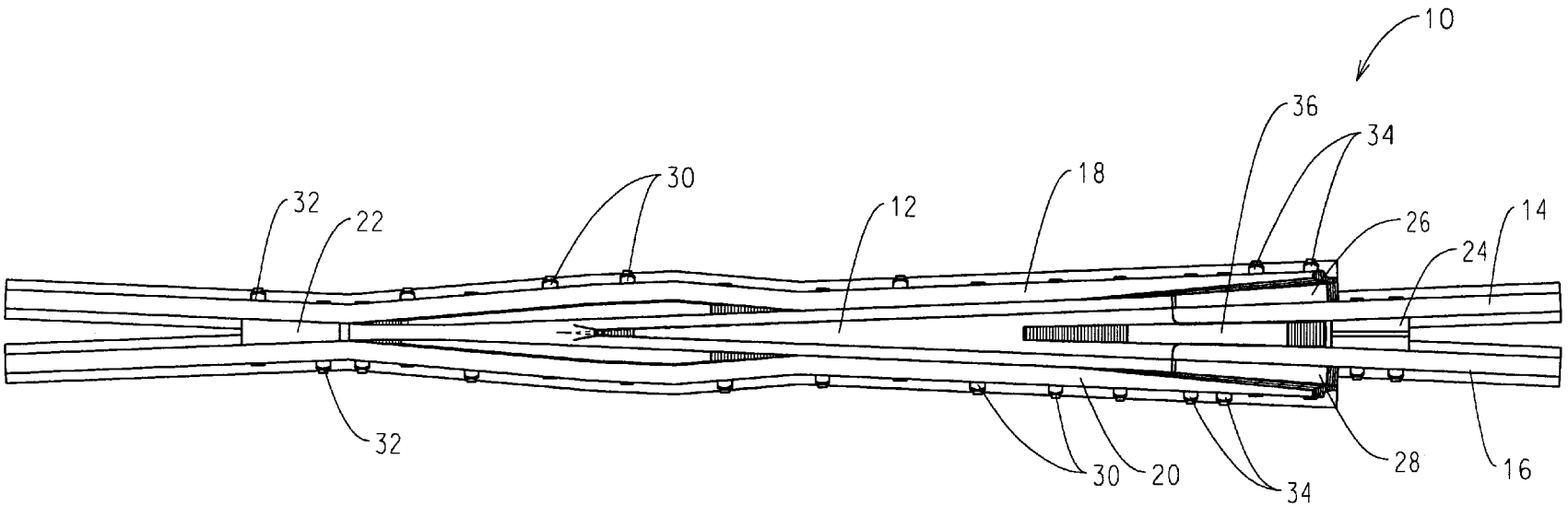
Fig. 1(PRIOR ART)
FIG. 1 is a plan view of a prior art RBM style of frog assembly.

FIG. 1 illustrates a prior art RBM frog assembly 10 comprising a casting or insert 12, heel rails 14 and 16, wing rails 18 and 20, toe block 22, heel block 24, and flare filler blocks 26 and 28. Bolts 30 secure the wing rails 18, 20 to the casting 12.

Similarly, bolts 32 secure the toe block between the wing rails 18, 20. Bolts 34 extend transversely through the heel extension 36 of the casting 12 and through the heel rails 14, 16 and the flare filler blocks 26, 28 to thereby secure the heel rails to the casting.

The several mechanical connections involved in an RBM frog result in high maintenance requirements. In particular, the mechanical connection between the heel rails 14, 16 and the casting 12 results in impact damage to the casting requiring relatively frequent repair or replacement.

Figure 2:
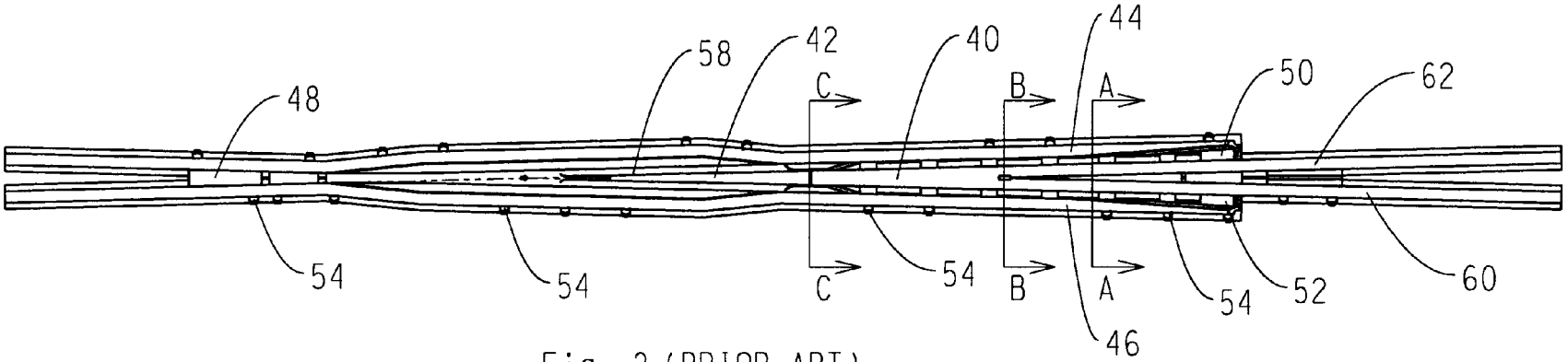
Fig. 2 (PRIOR ART)
FIG. 2 is a plan view of a prior art WHM style of frog assembly.

FIG. 2 illustrates a prior art WHM frog assembly 38. The assembly includes a heel rail assembly 40 which has been flash butt welded to the casting 42. The WHM frog assembly also includes wing rails 44 and 46, toe block 48, flare filler blocks 50, 52 and a plurality of bolts 54. It is to be noted that the heel rail assembly 40 extends to a connection point 56 which is relatively closer to the point of frog 58 than is the case with the heel rails of an RBM style of frog. Accordingly the WHM casting 42 is shorter than the RBM casting 12.

Figure 2A:
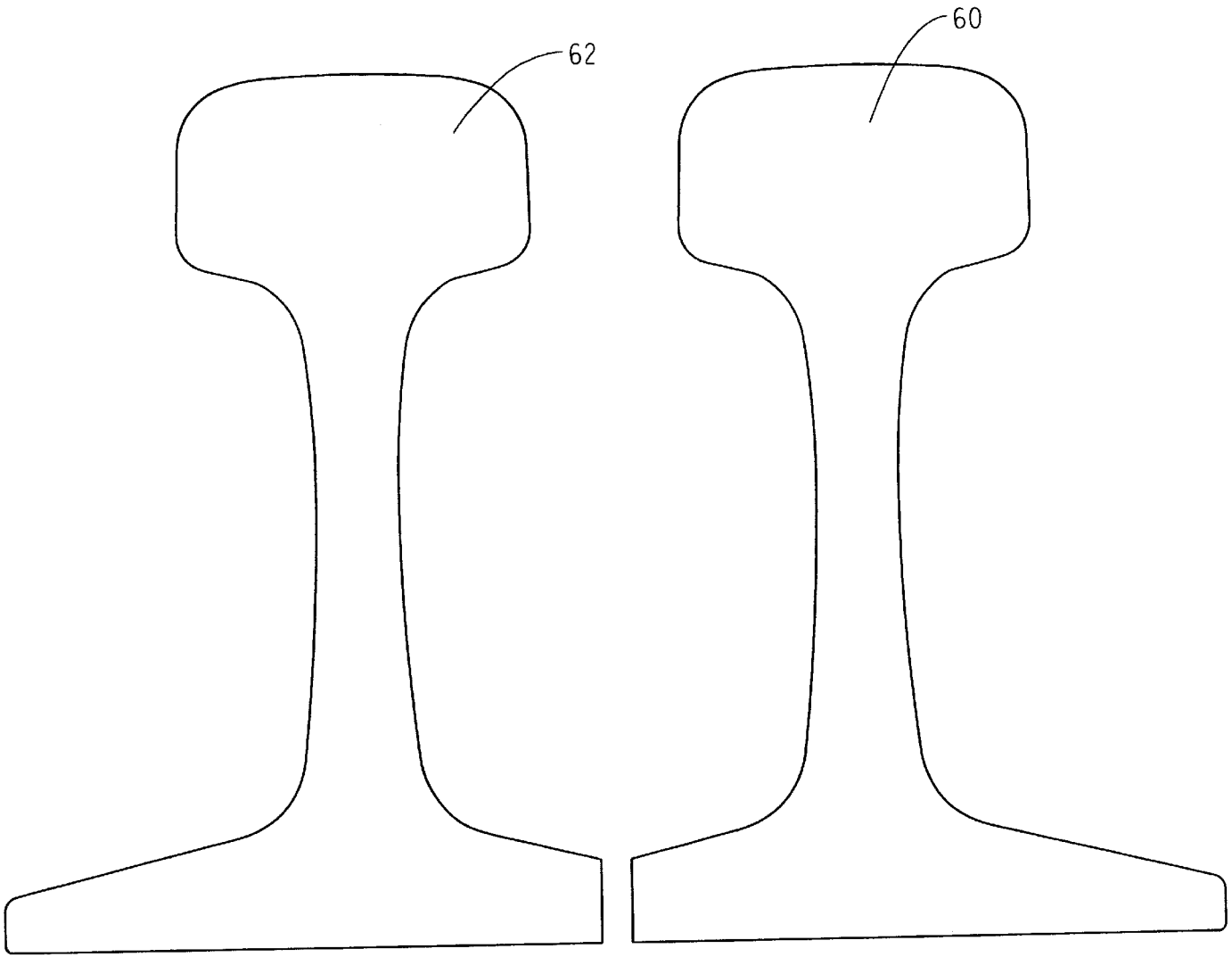
Fig. 2A (PRIOR ART)
FIG. 2A is a view taken along line A—A of FIG. 2.
Figure 2B:
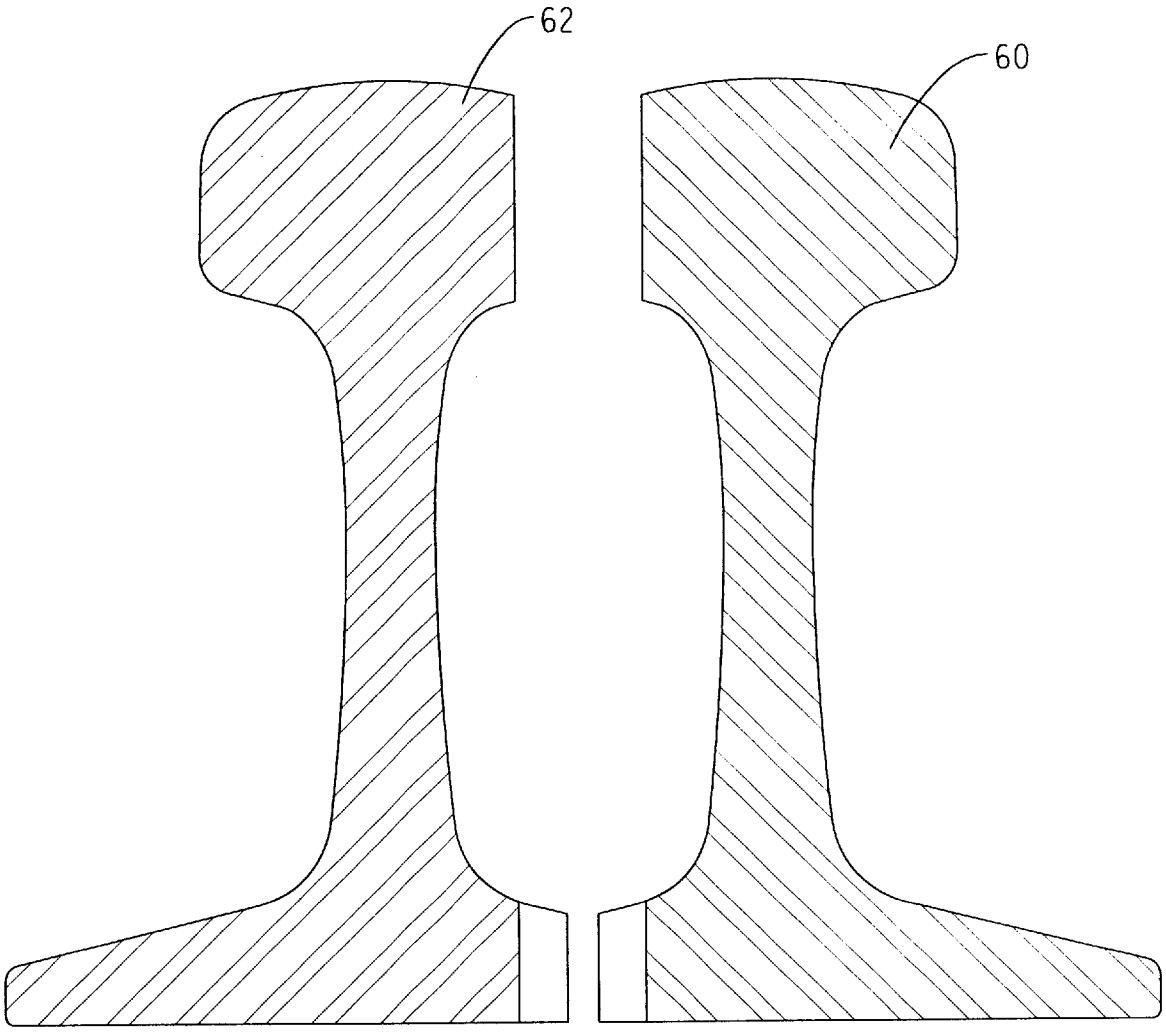
Fig. 2B (PRIOR ART)
FIG. 2B is a view taken along line B—B of FIG. 2.
Figure 2C:
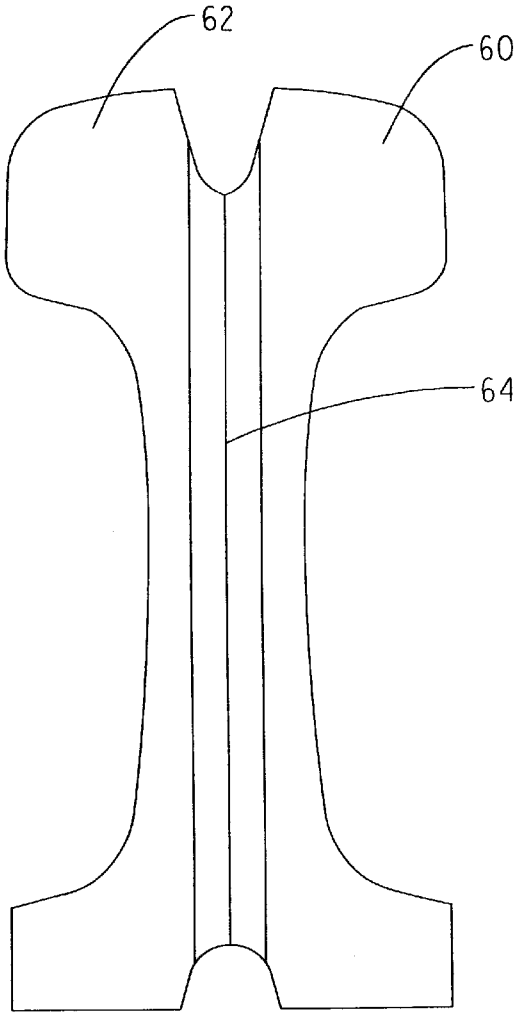
Fig. 2C (PRIOR ART)
FIG. 2C is a view taken along line C—C of FIG. 2.

Heel rail assembly 40 comprises two heel rails 60, 62 machined as illustrated in FIGS. 2A, 2B and 2C and welded as at 64 in FIG. 2C and in FIG. 2. As best appreciated by reference to FIG. 2, heel rail assembly 40 is flash butt welded to casting 42 at 56.

Figure 3:
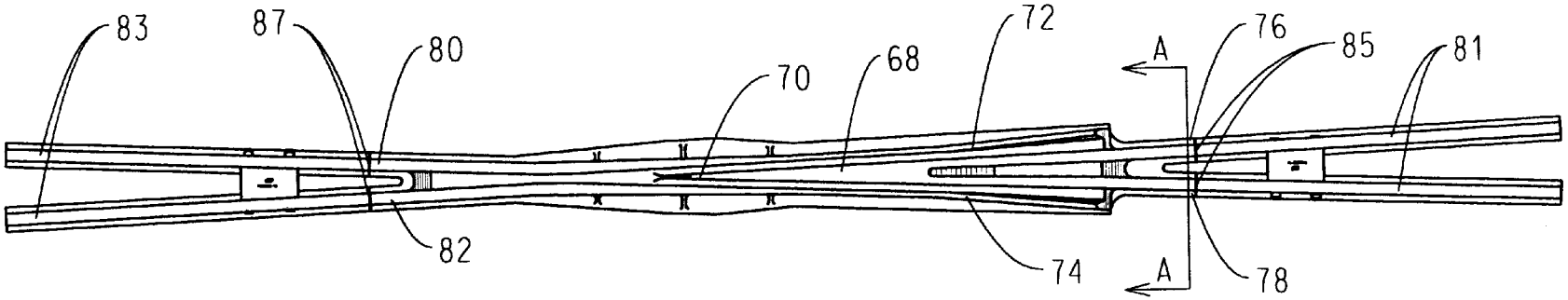
Fig. 3 (PRIOR ART)
FIG. 3 is a plan view of a prior art JBM frog assembly.
Figure 3A:
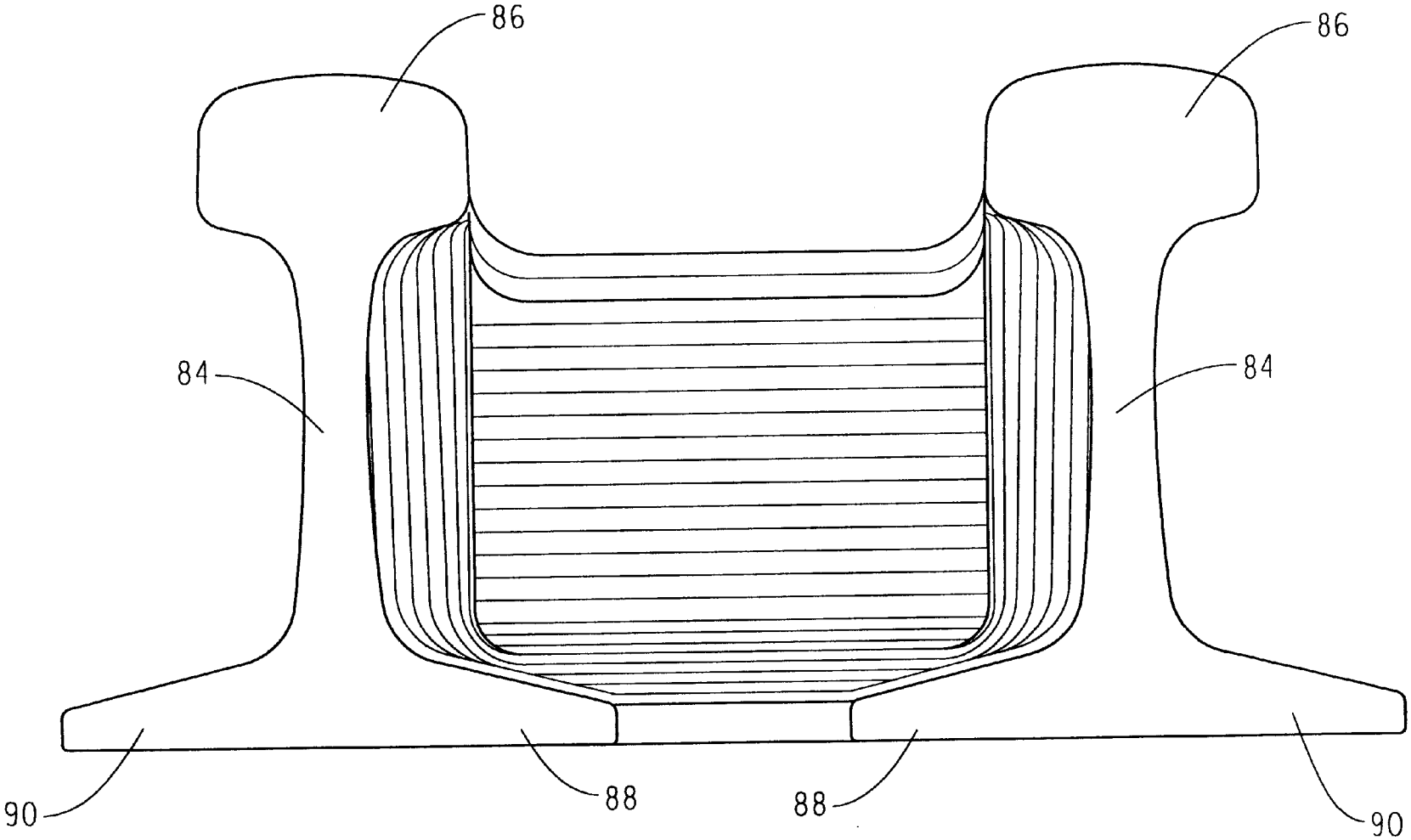
Fig. 3A (PRIOR ART)
FIG. 3A is a view taken along line A—A of FIG. 3.

FIG. 3 illustrates a prior art JBM frog assembly. The casting 68 includes a point of frog 70 and integral wing rail section 72, 74. The heel and toe ends of the casting 68 include simulated heel rail extensions 76, 78 and simulated toe rail extensions 80, 82. As seen in FIG. 3A, simulated heel rail extensions 76, 78 include web portions 84, head portions 86, inside base portions 88 and outside base portions 90. Simulated heel rail extensions 76, 78 and simulated toe rail extensions 80, 82 have the same simulated rail profile. Heel and toe end running rails 81 and 83 respectively are typically flash butt welded to the simulated heel and toe rail extensions 76, 78, 80 and 82 in the field, as at 85, 87.

The angle of frog which can be achieved by the JBM structure is limited by how closely adjacent the simulated heel rail extensions 76 and 78 can be brought to one another, and how closely adjacent the simulated toe rail extensions 80 and 82 can be brought to one another. Lower angles of frog could in fact be achieved by running the simulated rail extensions together a greater distance so that they achieve enough clearance from one another to begin defining a proper rail profile for attachment to the running rails. But this in turn would require a longer casting which is difficult to achieve with most foundries and which would be expensive due to the high cost of the alloys which are preferably used in such castings.

Figure 4:
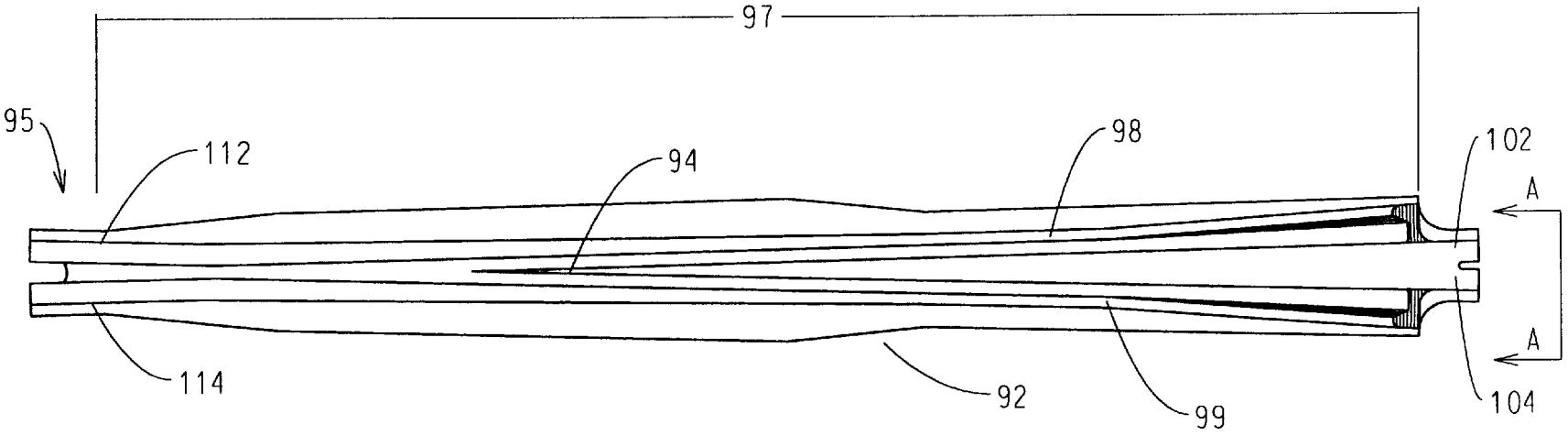
FIG. 4 is a plan view of a JBM type casting according to the invention.

FIG. 4 illustrates a JBM type of casting or insert 92 according to the invention. As in a prior art JBM, the casting includes a point of frog 94, a toe end 95, a heel end 96, a body portion 97 extending between the toe end 95 and the heel end 96 and integral wing rail sections 98, 99. However, the heel end 96 of the casting according to the invention also includes short and closely adjacent extensions 102, 104. Extensions 102, 104 extend in substantially the same direction away from the body portion 97 (in this case in the heelward direction). It will be understood however, that extensions 102, 104 will not be parallel and that the angle between them will be dictated by the angle of frog. As best seen in the end view of FIG. 4A, the end of each of extensions 102, 104 simulates the shape and cross-sectional profile of part of a rail, including heads 101 and webs 103 of simulated rails and portions of the bases 106, 108.

Providing extensions 102, 104 which generally match the profile of the rails to which they are to be attached minimizes stress risers upon welding the rails to the casting. However, by keeping extensions 102, 104 short, the overall length of the casting is also minimized. It has been found that the objects of the invention are achieved if extensions 102, 104 are just long enough to define the desired partial heel rail shape and profile. A typical length of extensions 102, 104 according to the invention would be about 6 inches.

Figure 4A:
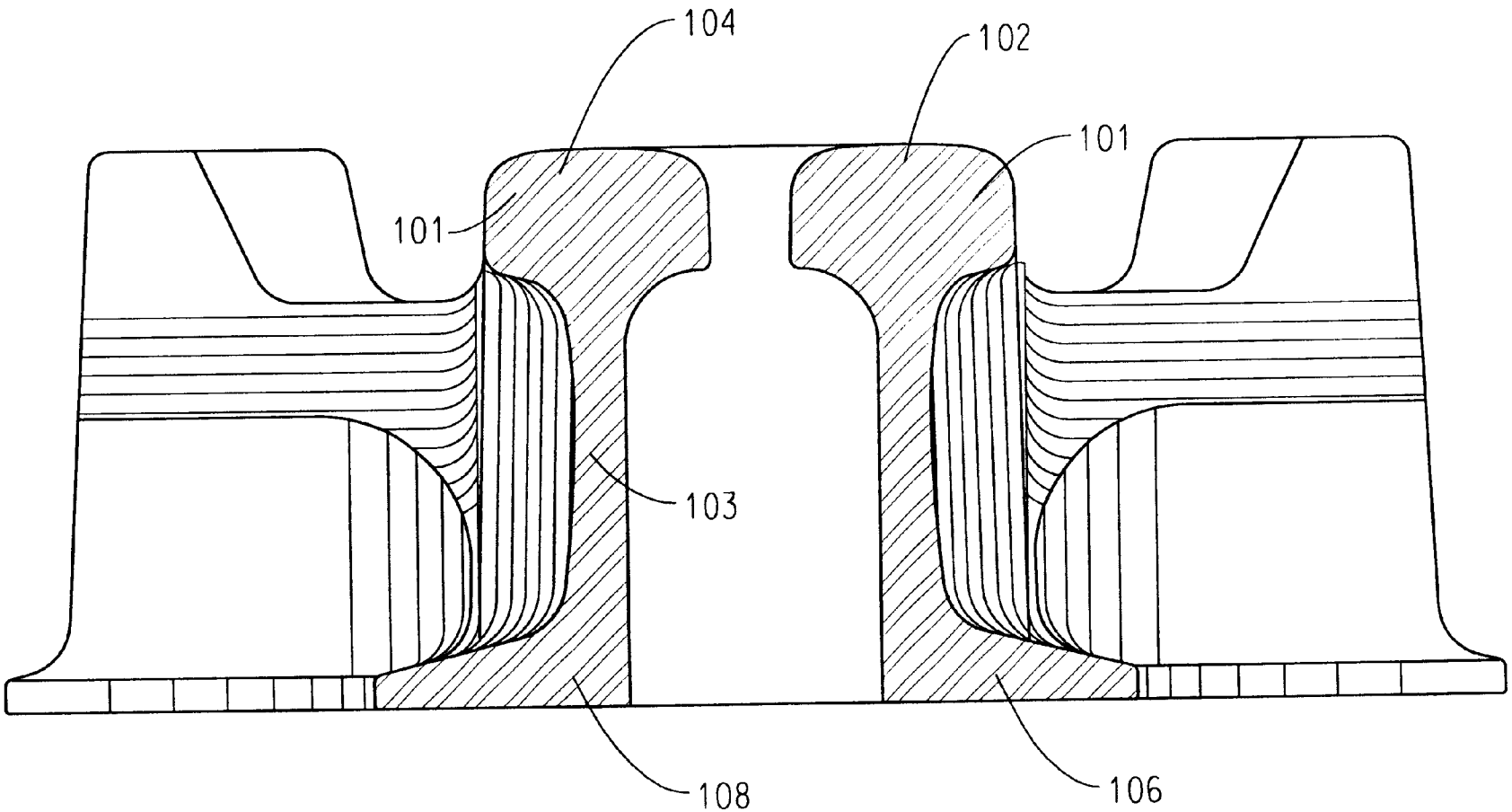
FIG. 4A is a view taken along line A—A of FIG. 4.

In order to further minimize the overall length of the casting, it is desirable to keep the body portion 97 of the casting as short as possible. However as one end of the body of the casting is brought closer to the point of frog, that end necessarily becomes narrower. As a result, extensions 102, 104 would need to extend relatively farther away from the body to compensate for the narrowness of the end of the casting and in order to be able to define two substantially complete profiles of rails. This would normally defeat the objective of keeping the overall length of the casting short. The problem is overcome in the invention by making extensions 102, 104 such that the inside portion of the base of the simulated rails is missing as seen in FIG. 4A. The end of each of the extensions 102, 104 defines only a single side of what would normally be the base 106 or 108 of a simulated rail, namely the side which is opposite to its companion extension. The missing sides of the bases 106, 108 are therefore the sides which would normally face the adjacent extension. This allows extensions 102 and 104 to be brought closely adjacent while still defining two separate and substantially functional simulated heel rails.

To achieve this, the insert may be cast without the inside portions of the bases, but as presently contemplated, the preferred approach is to initially cast the insert with at least partial inside portions of the base and then to machine the base to remove them. Thus the initial casting only roughly defines the desired profile of the ends of the extensions 102, 104, with enlarged portions, and the ends are then machined to the desired final shape. This provides an opportunity to design a casting and a final product which maximizes the hardness at various points in the casting.

Thus a frog assembly according to the invention is created by providing a casting as described above (i.e. with extensions in which the inside portion of the base is removed or missing), machining rails to remove the inside portion of the base near the end which will be attached to the casting, and welding the rails (preferably by flash butt welding) to the extensions 102, 104. As it is desirable to ensure a matching profile when connecting the rails to the casting, the ends of the rails which are to be attached to the casting extensions 102, 104 are also machined to remove the inside portion of the base prior to welding them to the extensions. This allows the rails to also be brought closely adjacent and to match the profile of the extensions 102, 104.

It is desirable to have the rail end and the extension end profiles match very closely. In order to achieve such close tolerances, when the inside base portion of the extension and of the rail is machined, a portion of their webs and heads are also machined to a controlled depth. This allows the close matching of the profiles. After welding the rails to the extensions, further machining of the inside portions of the joint is performed, including the base, web and head areas. This allows slag and upset material from the weld to be cleaned away, and also serves to harden the joint. This post-weld machining is performed using a suitable tool such as a disc grinder introduced from the bottom through a gap left by the absence of the inside base portions of the extensions and rails. The process is repeated by introducing a suitable tool through a gap formed between the machined inside portions of the heads of the adjacent rails.

Thus the insert according to the invention is relatively short but allows for relatively small angles of frog, and overcomes the problem of mechanical connection to the running rails.

In a JBM type of casting, the casting according to the invention is also provided with additional extensions 112, 114 extending in substantially the opposite direction to extensions 102, 104. While extensions 102, 104 illustrated in FIG. 4 are heel end extensions, extensions 112, 114 are toe end extensions. Extensions 112, 114 are similarly closely adjacent and short. As in the case of the heel end, toe rails are first machined to remove the inside portion of the base of the rails prior to welding them to extensions 112, 114.

Figure 5:
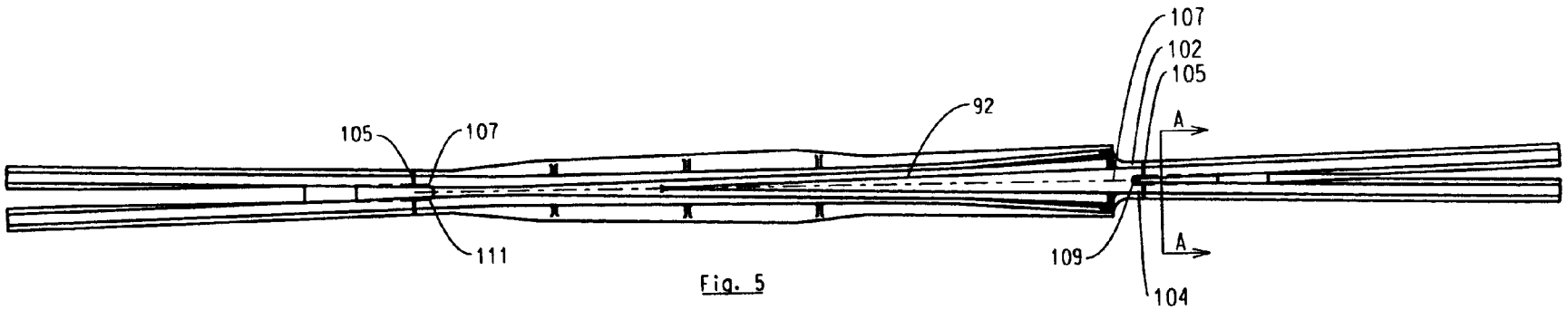
FIG. 5 is a plan view of a JBM type frog assembly according to the invention.
Figure 5A:
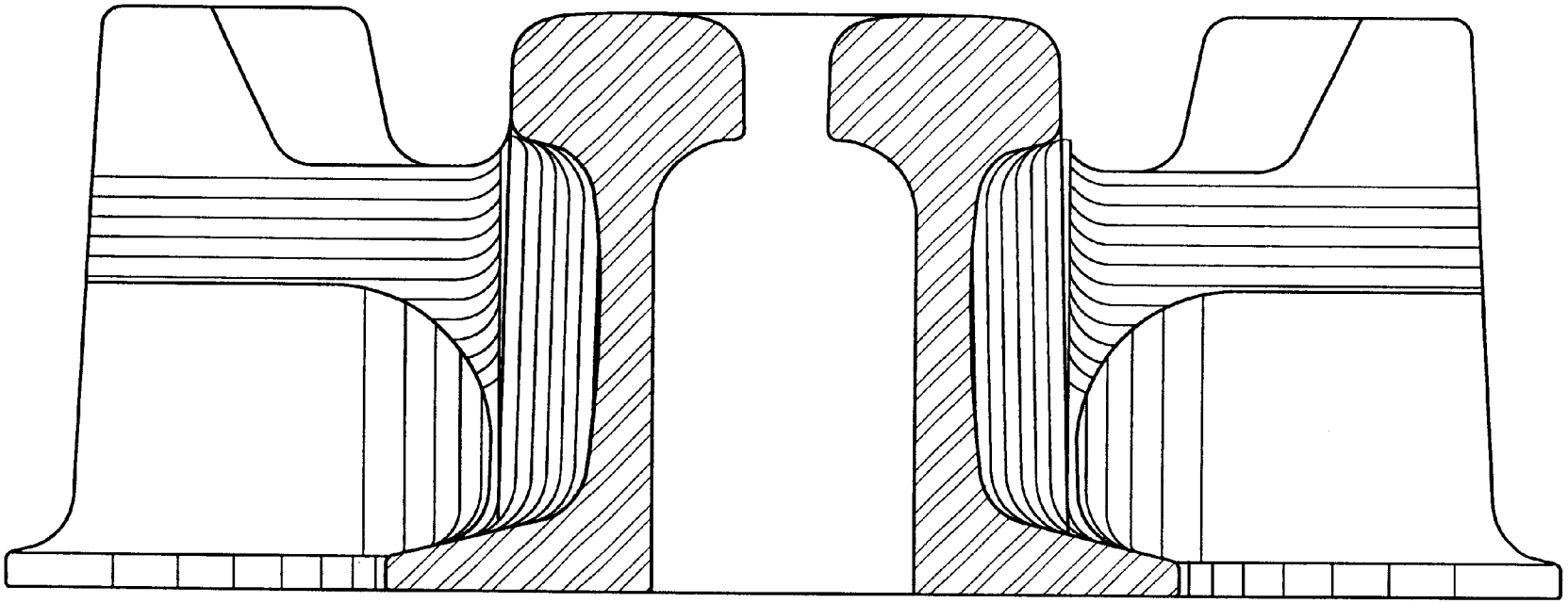
FIG. 5A is a view taken along line A—A of FIG. 5.

A JBM frog assembly constructed according to the invention is illustrated in FIG. 5. FIG. 5A illustrates the profiles of the heel rails both of which have been machined to remove the inside base portions. The profile of the end of the heel rails is therefore made to match the profile of the extensions to which the rails are attached. The assembly is manufactured by first providing a cast insert 92 as described above. Each of two rails is then machined to remove one side of the base of each rail near one end of the rail. The machined end of each of the two rails is then attached by welding it to respective ones of the extensions 102, 104 such that the sides of the rails from which the base has been machined away face from one another.

Preferably the inside base portions of the extensions have been machined so as to provide a gradual change of profile from the tips 105 to the point 107 at which the body of the casting becomes defined. This is best appreciated by reference to FIG. 5 at 109, 111, which illustrates a taper of the inside of the base portion of the simulated rail extensions.

Figure 7:
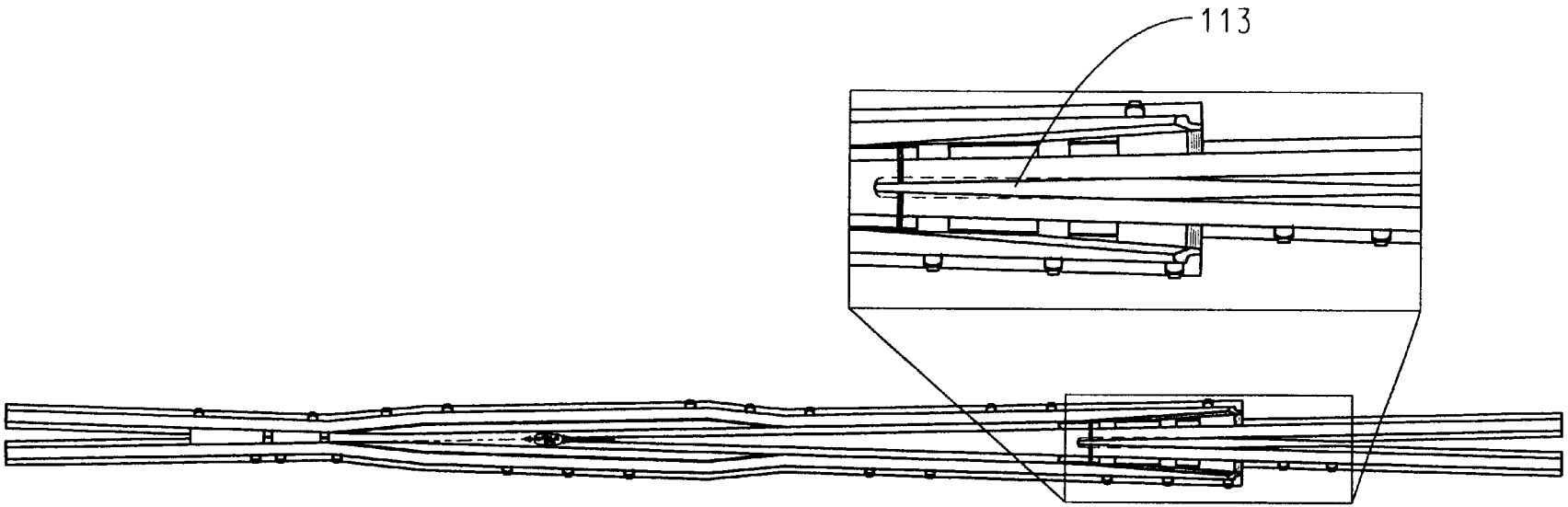
FIG. 7 is a plan view of a frog assembly according to the invention showing an enlarged view of a portion of the assembly.

As will also be appreciated by reference to FIG. 7 the effect of the approach of the invention is to provide a gap 113 between the rails near the body portion of the casting. This gap is useful to allow the introduction of a tool to remove slag and other upset material which results from welding the rails to the casting.

Figure 6:
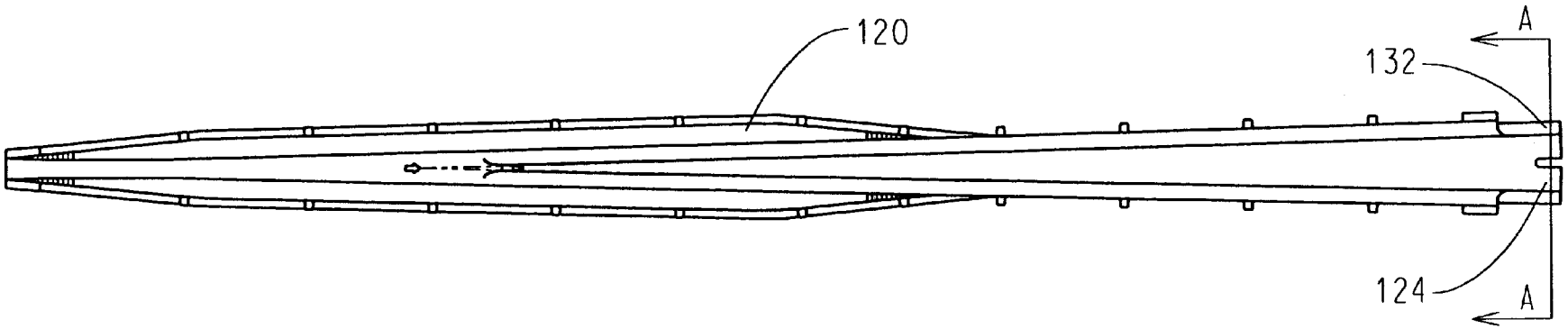
FIG. 6 is a plan view of a WHM type casting according to the invention.
Figure 6A:
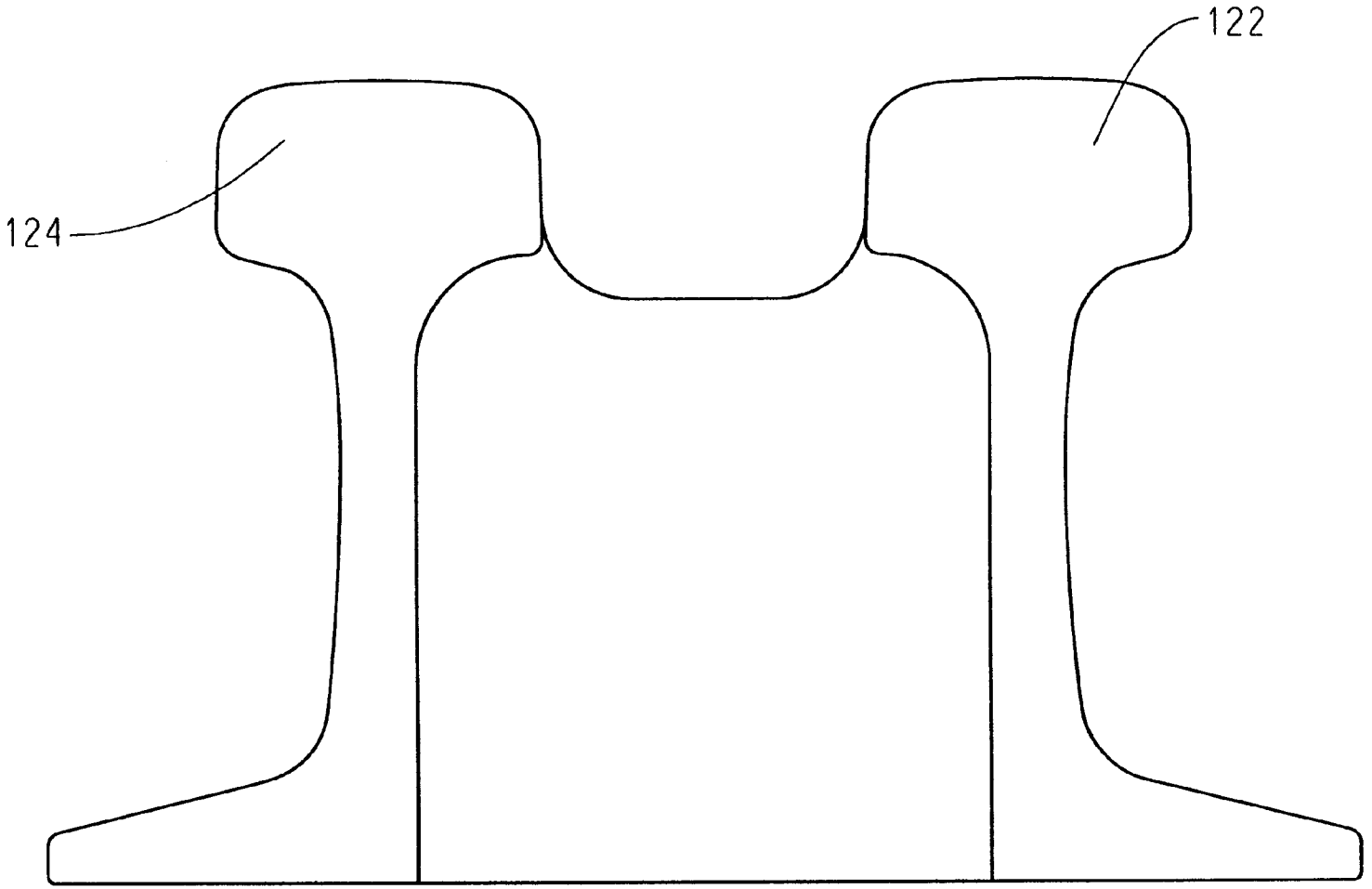
FIG. 6A is a view along line A—A of FIG. 6.
Figure 8:
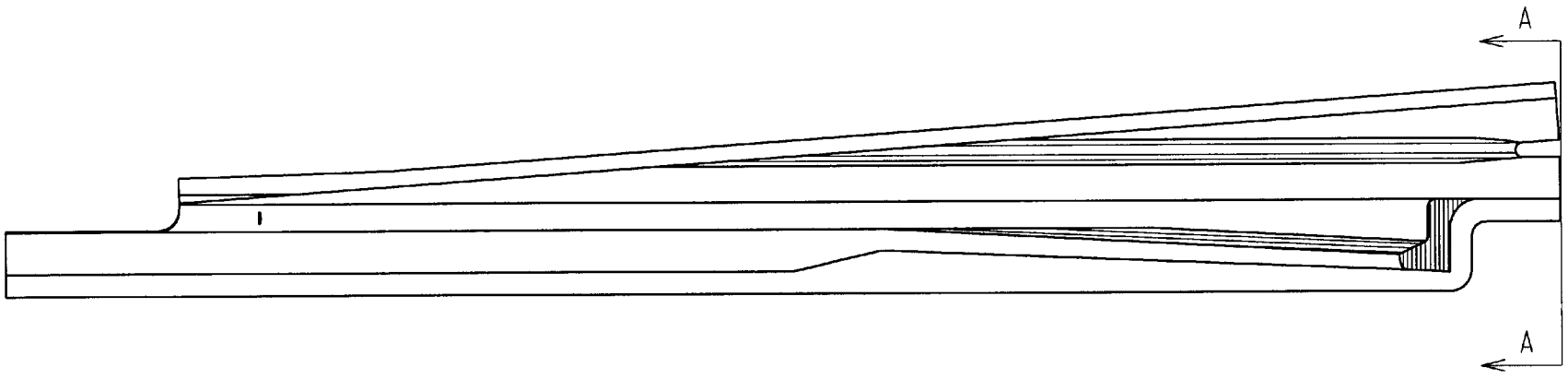
FIG. 8 is a plan view of a Welded Spring Manganese frog casting according to the invention.
Figure 8A:
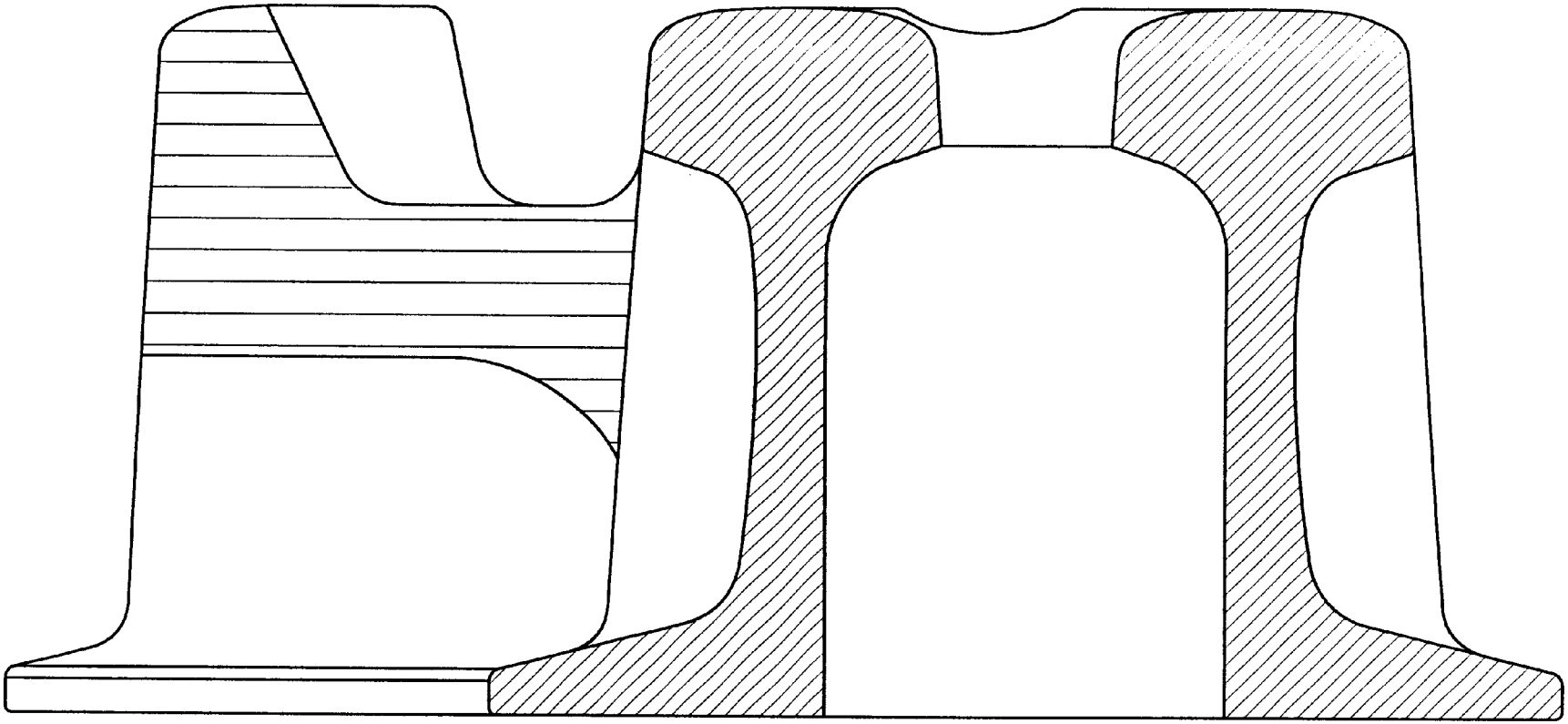
FIG. 8A is a view taken along line A—A of FIG. 8.
Figure 9:
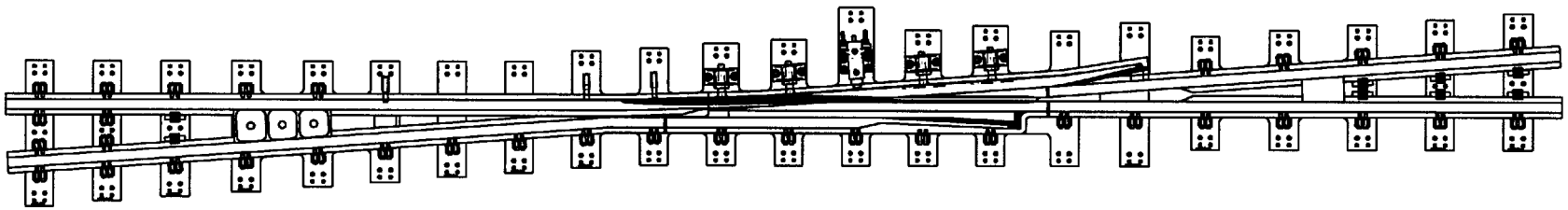
FIG. 9 is a plan view of a Welded Spring Manganese frog assembly according to the invention.
Figure 10:
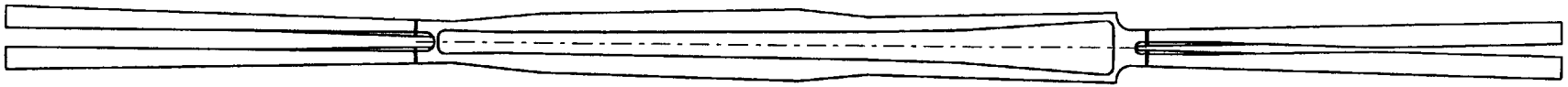
FIG. 10 is a plan view of an RBM type of casting according to the invention.

The invention may be applied to virtually any type of frog casting and frog assembly involving the connection of the casting to two heel or two toe rails. For example, FIG. 6 illustrates a WHM type of casting 120 according to the invention and FIG. 6A illustrates the simulated heel rail profile of extensions 122, 124. FIGS. 8 and 8A illustrate a Welded Spring Manganese (WSM) frog casting according to the invention and FIG. 9 illustrates a WSM assembly according to the invention. It will be appreciated that the WSM type of castings according to the invention does not include integral simulated wing rails in the casting.

The invention is also applicable to forms of attachment of the heel or toe rails other than welding. Even were it not important to match the profiles of the rails with the extensions, the invention nonetheless allows the rails to be brought very close together. This in turn allows the casting to be made for smaller angles of frog than would be available without the invention.

The invention is applicable to reduce the length of castings and to decrease the angle of frog with which castings can be used regardless of the alloy used in the casting. However, the invention sees its greatest advantages in decreasing the costs associated with high cost alloys which are typically used in frogs, such as manganese steel.

It will be appreciated by those skilled in the art that variations to embodiments described herein may be practised without departing from the scope of the invention as generally described herein and as more particularly defined by the claims.

What is claimed is:

1. The method of manufacturing a frog assembly comprising the steps of:

providing a single piece cast insert for a railway frog, said insert comprising a toe end, a point of frog, a heel end, and a body portion extending between said toe end and said heel end, two extensions extending from said heel end in substantially a same first direction away from said body portion, each of said extensions having an end defining a cross sectional profile corresponding to a head of a rail, a web of a rail, and only one side of a base of a rail such that the sides of the extensions from which there is no base face one another;

machining each of two rails so as to remove one side of a base of each rail near the end of the rail; and attaching the machined end of each of the two rails to the ends of respective ones of said extensions such that the sides of the rails from which the base has been machined away face one another.

2. The method according to claim 1 wherein the step of machining each of the two rails is performed so as to cause the resulting rail ends to have a profile matching the profile of the extension to which the rail end will be attached.

3. The method as in claim 2 wherein the attaching strep is by performed welding.

4. The method as in claim 3 wherein said welding is flash butt welding.

5. The method as in claim 4 further comprising the step of machining inside portions of the weld area.

6. The method as in claim 5 comprising the additional step of removing slag and upset material resulting from the weld by means of a tool introduced through a gap created by the missing inside base portions of the extensions and rails.

7. The method according to claim 6 further comprising the step of removing slag and upset material resulting from the weld by means of a tool introduced through a gap between a head of the adjacent extensions and rails in the area of the joint.

8. The method of manufacturing a frog assembly comprising the steps of:

providing a cast insert, said insert comprising a toe end, a point of frog, a heel end, a body portion extending between said toe end and said heel end, and two extensions extending generally in one direction from said body portion and being generally adjacent to one another, each of said extensions having an end defining a cross sectional profile corresponding to a partly enlarged cross-sectional profile of a rail, said cross-sectional profile of a rail consisting of a head of a rail, a web of a rail and a base of a rail;

machining each of said extensions to give each of said extensions the cross sectional profile of a rail save for the portion of the base of said rail extending from the web of the rail toward the adjacent one of said extensions;

machining one end of a first rail so as to match the profile of one of said extensions and machining one end of a second rail so as to match the profile of the other of said extensions; and attaching the machined ends of said rails to the respective extensions to which their profiles are matched.

9. The method of claim 8 wherein the attaching step is performed by welding.

10. The method of claim 9 wherein said welding is flash butt welding.

11. The method of claim 10 comprising the further step of machining inside portions of the weld area which correspond to the base, web and head areas of the rail.

12. The method of claim 11 comprising the additional step of removing slag and upset material resulting from the weld by means of a tool introduced through a gap created by the machined inside base portions of the extensions and rails.

* * * * *